US011225091B2

(12) United States Patent
Boucher et al.

(10) Patent No.: US 11,225,091 B2
(45) Date of Patent: Jan. 18, 2022

(54) PRINT MEDIA PRESSURE PLATES

(71) Applicant: Hewlett-Packard Development Company, L.P., Houston, TX (US)

(72) Inventors: Peter J Boucher, Vancouver, WA (US); Jason Y. Carothers, Vancouver, WA (US); Warren K Harwood, Vancouver, WA (US); Luke P Sosnowski, Camas, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/761,508

(22) PCT Filed: Dec. 22, 2015

(86) PCT No.: PCT/US2015/067296
§ 371 (c)(1),
(2) Date: Mar. 20, 2018

(87) PCT Pub. No.: WO2017/111936
PCT Pub. Date: Jun. 29, 2017

(65) Prior Publication Data

US 2018/0264853 A1 Sep. 20, 2018

(51) Int. Cl.

| | |
|---|---|
| ***B65H 7/14*** | (2006.01) |
| ***B41J 11/00*** | (2006.01) |
| ***B65H 5/36*** | (2006.01) |
| ***B41J 11/08*** | (2006.01) |

(52) U.S. Cl.
CPC ..... *B41J 11/0095* (2013.01); *B41J 11/005* (2013.01); *B41J 11/08* (2013.01); *B65H 5/36* (2013.01); *B65H 7/14* (2013.01); *B65H 2404/611* (2013.01); *B65H 2553/44* (2013.01)

(58) Field of Classification Search
None
See application file for complete search history.

(56) References Cited

U.S. PATENT DOCUMENTS

| | | | | |
|---|---|---|---|---|
| 4,438,917 A | | 3/1984 | Roller | |
| 5,101,284 A | * | 3/1992 | Tanabe | H04N 1/04 358/461 |
| 5,278,624 A | | 1/1994 | Kamprath et al. | |
| 5,329,378 A | * | 7/1994 | Lee | H04N 1/0057 358/400 |
| 5,391,009 A | | 2/1995 | Stodder | |

(Continued)

FOREIGN PATENT DOCUMENTS

| | | |
|---|---|---|
| JP | 6374825 | 4/1988 |
| JP | 0881122 | 3/1996 |

(Continued)

*Primary Examiner* — Alejandro Valencia
(74) *Attorney, Agent, or Firm* — HP Inc. Patent Department

(57) ABSTRACT

Examples described herein include examples print media handling system including a first media guide assembly comprising a sensor assembly, and a second media guide assembly comprising a retractable pressure plate and disposed opposite the first media guide assembly to guide a print media along a path between the first media guide assembly and second media guide assembly, the pressure plate moveable about an axis perpendicular to the path between an actuated position and a retracted position.

16 Claims, 5 Drawing Sheets

(56) References Cited

U.S. PATENT DOCUMENTS

| | | | | |
|---|---|---|---|---|
| 5,715,514 | A | 2/1998 | Williams | |
| 5,764,382 | A | 6/1998 | Shiraishi | |
| 5,784,087 | A | 7/1998 | Wallace et al. | |
| 6,805,429 | B2 | 10/2004 | Khalid | |
| 7,441,768 | B2 | 10/2008 | Dan | |
| 7,499,158 | B2 * | 3/2009 | Flemming | G03G 15/5062 356/243.1 |
| 8,297,616 | B2 | 10/2012 | Tharayil | |
| 8,373,733 | B2 | 2/2013 | Yamada | |
| 8,562,098 | B2 | 10/2013 | Yasutani et al. | |
| 8,699,102 | B2 * | 4/2014 | Sumioka | H04N 1/00031 358/498 |
| 8,848,208 | B2 | 9/2014 | Sumioka | |
| 8,991,962 | B2 * | 3/2015 | Gerrits | B41J 2/07 347/15 |
| 9,126,444 | B2 | 9/2015 | Wakayama | |
| 2009/0016796 | A1 | 1/2009 | Tsuchiya et al. | |

FOREIGN PATENT DOCUMENTS

| | | |
|---|---|---|
| JP | 2013086347 | 5/2013 |
| JP | 2013115476 | 6/2013 |

* cited by examiner

PRINT MEDIA PRESSURE PLATES

BACKGROUND

Printing devices often include integrated sensors for sensing the position of print media, calibrating printing elements, or evaluating the performance of the various other components, such as the print elements and paper handling systems. Various types of sensors can be used. Pressure sensors, proximity sensors, magnetic sensors, optical sensors, and the like, can all be used to sense various conditions in the printing device. In some scenarios, a mechanical pressure sensor can be used to sense the presence of print media (e.g., a piece of paper or cardstock). In other applications, an optical sensor can be used to image, or otherwise detect, the quality of an image printed on a print media. For example, an optical sensor can be used to detect the physical or operational alignment of print nozzles or print heads, measure the fidelity of color reproductions, track variations of ink density, and the like.

DETAILED DESCRIPTION

Figure 1:
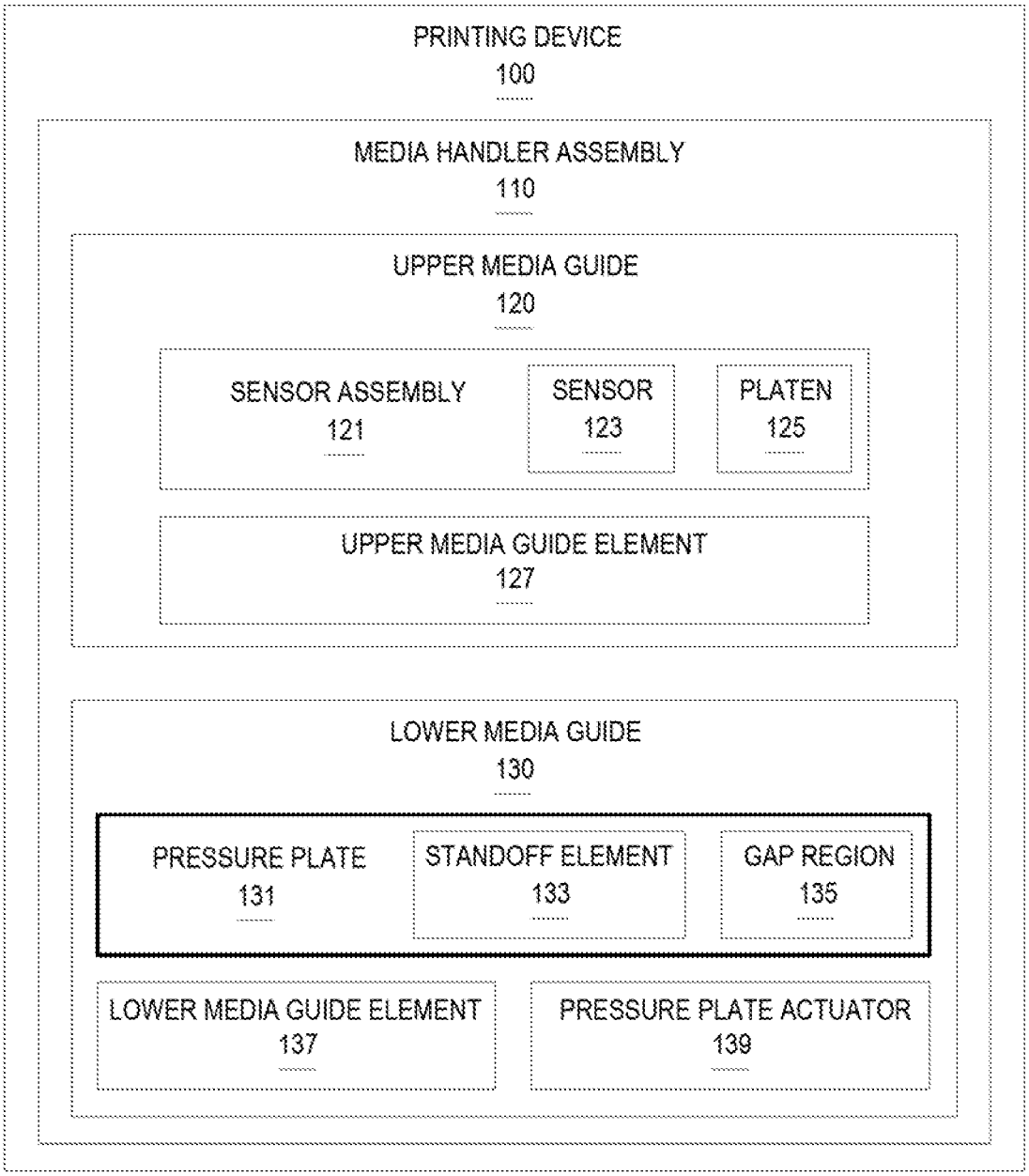
FIG. 1 depicts an example printing device in which various aspects of the present disclosure can be implemented.

FIG. 1 depicts an example printing device 100 that includes various features according to the present disclosure. As shown, the printing device 100 can include, in addition to print engines, power components, user interface devices, and other components not depicted in FIG. 1, a media handler assembly 110. In various implementations, the media handler assembly 110 can include functionality and mechanisms for moving print media, such as paper, relative to the other components of the printing device 100. For example, the media handler assembly 110 can include rollers for moving the print media along a particular media path and vacuum elements for holding the print media in place or flush against a particular surface to ensure proper alignment of a printed image. The media handler assembly 110 can thus include various print media guide elements that include, house, support, and/or contain components for guiding, transporting, aligning, sensing, and/or printing print media. For example, the print media guide elements can include services and rollers that define a particular media path through which print media is guided so as to be presented or exposed to various components of the printing device 100.

In the particular example printing device 100 shown, the media handler assembly 110 can include a first, or upper, media guide 120 and a second, or lower, media guide 130. In such implementations, the upper media guide 120 and the lower media guide 130 can include surfaces and/or rollers disposed relative to one another to define a particular print media path through which to guide the printing device 100. In addition to the services and/or rollers, the upper media guide 120 and the lower media guide 130 can include components that the printing device 100 can activate or deploy to carry out specific media handling, printing, or sensing functionality.

In one example implementation, the upper media guide 120 can include a sensor assembly 121 and the upper media guide element 127. The upper media guide element 127 can include surfaces, rails, vacuum elements, blower elements, rollers, and other elements for physically handling or guiding print media through the printing device 100. The sensor assembly 121 can be disposed in or supported by the upper media guide element 127 in a position so as to sense or detect print media passing along the upper media guide element 127.

For example, the upper media guide element 127 can support the platen 125 as part of the surface along which the print media moves. The platen 125 can include any material through which the sensor 123 can detect various features of the print media as it passes through the media path. For example, the platen 125 can include an optically clear or transparent window through which an optical sensor can detect the surface of the print media as it passes through the print media path. When detecting the surface of the print media, the optical sensor of the sensor 123 can detect surface defects, ink or images deposited on the surface, tears, rips, edges, etc. Accordingly, the sensor 123 can be used to detect features of a printed media that can be used to inform the operations of the printing device 100. For example, sensor 123 can evaluate the density of ink dots deposit on the print media surface and/or evaluate the alignment of printed features. As such, information gathered by the sensor 123 can be used to provide initial calibration information, or detect malfunctions or defects in various printing mechanisms.

In some implementations, the sensor 123 can include an optical sensor. For example, the sensor 123 can include a single or an array of photodetectors that can detect differences in light levels reflected off the surface of the print media through the platen 125. As such, in some example implementations, the sensor assembly 121 and/or the sensor 123 can include a light source for illuminating the surface of the print media through the platen 125.

Optical sensors used in such implementations can have an associated working distance at which features printed on print media can be reliably or accurately detected. In some implementations, the working distance corresponds to the depth of field of any optical components associated with or included in the sensor 123. Such optical components can include the platen 125 and/or lenses used to focus on objects (e.g. the surface of the print media) at the surface of the platen 125 or within some small distance therefrom. In such implementations, the working distance of the sensor 123 is referred to as the depth of field. The depth of field can refer to the distance from the sensor 123 and/or the platen 125 at which the sensor 123 can resolve features. In some implementations, the choice of optical sensor included in the sensor 123 can greatly influence the size of the depth of field. In particular, some optical sensors that can be selected have an shallow depth of field that requires that objects to be sensed by the sensor 123 be physically located within a small spatial region.

The scale of the depth of field of an optical sensor included in sensor 123 can be smaller than the gap between the upper media guide 120 and the lower media guide 130. In particular, the spacing between the upper media guide element 127 or the platen 125 and the lower media guide element 137 may allow for print media to be located within acceptable tolerances relative to a print engine or rollers but be too far away from the surface of the platen 125 for the sensor 123 to accurately detect features printed thereon. Accordingly, in various implementations the present disclosure, the lower media guide 130 can include a retractable pressure plate 131. In the interest of clarity and brevity, the "term retractable pressure plate" and "pressure plate" can be used interchangeably to refer to various implementations of the present disclosure that include the functionality of the pressure plate 131 described herein.

In various example implementations described herein, the pressure plate 131 can include a standoff element 133 and a gap region surface 135. In scenarios in which print media is in the print media path and the sensor 123 is activated to detect features on the print media, it is possible for the pressure plate 131 to be actuated by the pressure plate actuator 139 to move the print media away from the lower print guide element 137 and towards the platen 125 and/or sensor 123.

In such implementations, the pressure plate 131 can be actuated from a retracted position within the lower media guide 130 to be disposed such that the standoff element 133 is in contact with the platen 125 and/or the upper media guide element 127 to place the gap region surface 135 at a set distance from the sensor 123 and/or platen 125. As such, the gap region surface 135 can maintained at a uniform gap or distance relative to the sensor assembly 121. In various implementations described herein, the standoff element 133 can include multiple physical elements with a height offset from the gap region surface 135. As such, when the pressure plate 131 is disposed in the actuated position by the pressure plate actuator 139, the gap region surface 135 can be disposed at a distance from the sensor 123 and/or platen 125 at a working distance associate with the sensor assembly 121. Example implementations of the pressure plate 131 are described in more detail below in reference to the FIGS. 2 through 6.

Figure 2:
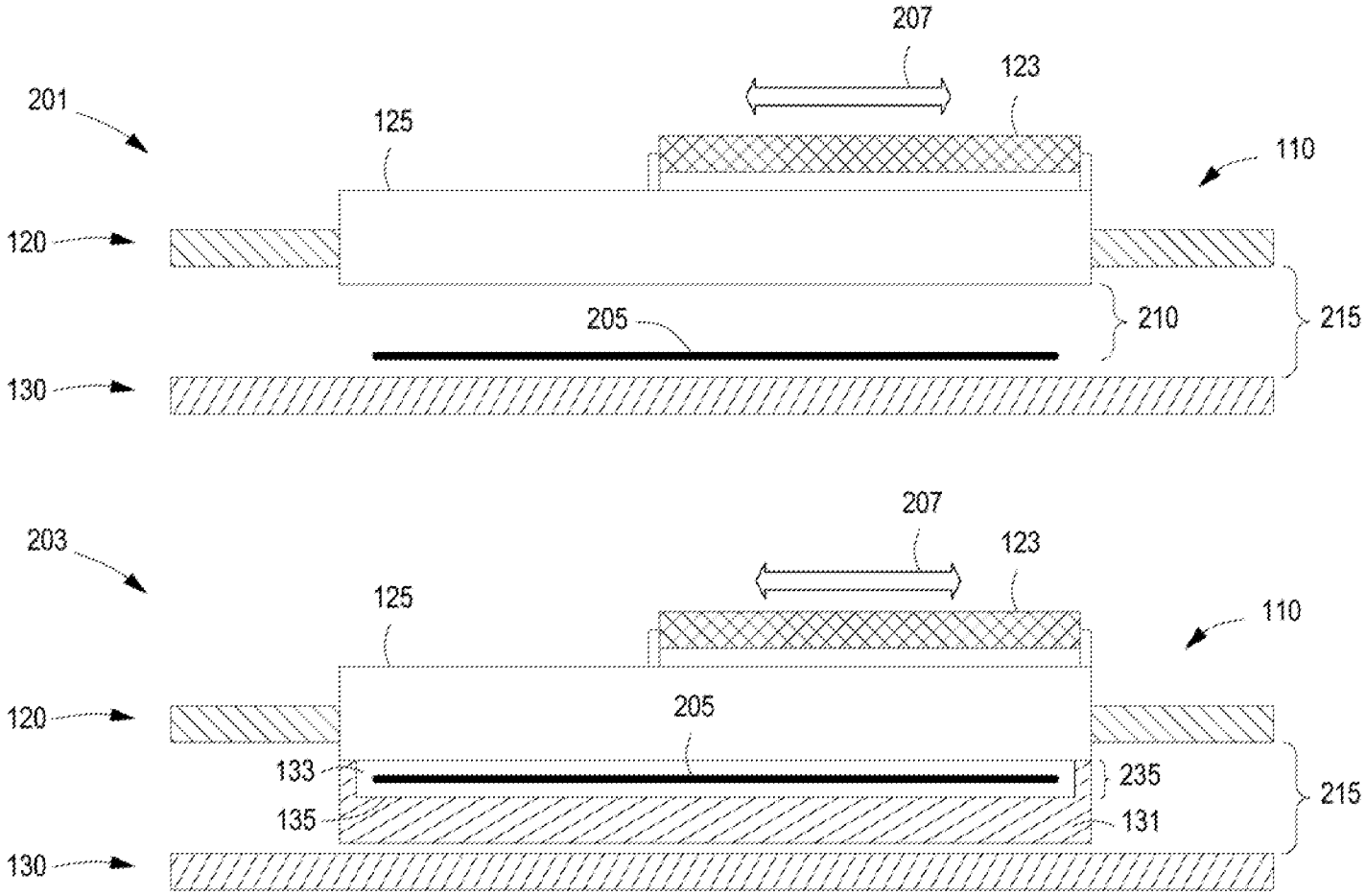
FIG. 2 depicts cross sectional views of an example print media handling system that includes a pressure plate in a retracted position and an actuated position.

FIG. 2 depicts two cross-sectional schematic views of example media handler assembly 110. In view 201 the media handler assembly 110 is shown with the pressure plate 131 in a retracted position (e.g., hidden from view below the surface of the lower media guide 130). In view 203, the media handler assembly 110 is shown with the pressure plate 131 in an actuated position.

In view 201, the print media 205 is passing through the print media path 215 defined between the upper media guide 120 and lower media guide 130 in a direction perpendicular to the page (e.g., the print media is traveling in or out of the page). As shown, the upper media guide 120 can support or include elements of the sensor assembly 121, such as the platen 125 and the sensor 123. In some implementations, the sensor 123 can move in directions indicated by arrow 207 to scan across the width of the platen 125 to detect, sense, or image the entirety or portion of the print media 205.

As shown, when the pressure plate 131 is in the retracted position of view 201, the print media 205 can be disposed at a distance 210 from the surface of the platen 125 and a corresponding distance from the sensor 123. As described herein, the distance of 210 at which the print media 205 travels through the print media path 215 can be outside of the working distance or depth of field of the sensor 123 during normal operation of the printing device 100 that includes the media handler assembly 110. In various implementations, the term normal operation refers to any operation in which print media 205 is moved through the print media path 215 for processing. Such processing can include printing, drying, creasing, stapling, and the like. For example, the print media 205 can travel through the print media path 215 at a distance 210 corresponding to an acceptable distance from a print engine (e.g., an inkjet print head, nozzle, sprayer, etc.) to generate the printed image having an acceptable print quality.

The distance 210 between the print media 205 and the platen 125 and/or sensor 123 maintained in the print media path 215 during normal operation may be too distant from the platen 125 and/or the sensor 123. For example, at a distance 210, the print media 205 may be beyond the depth of field of an optical sensor included in the sensor 123. To move or press the print media 205 closer to the platen 125 and/or sensor 123, the pressure plate 131 can be actuated.

In view 203, the pressure plate 131 is shown in the actuated position. In the actuated position, the pressure plate 131 can press or position the media 205 within a distance of 235 of the platen 125 and a corresponding distance from the sensor 123. As illustrated, the distance 235 depicted in view 203 is shorter than the distance 210 depicted in view 201.

To maintain the print media 205 at distances less than or equal to distance 235, the pressure plate 131 can include a gap region surface 135 held at the appropriate distance from the platen 125 by standoff elements 133. As shown, the standoff elements 133 can be dimensioned to make contact with the surface of the platen 125 so that the gap region surface 135 is maintained at a distance 235.

Figure 3:
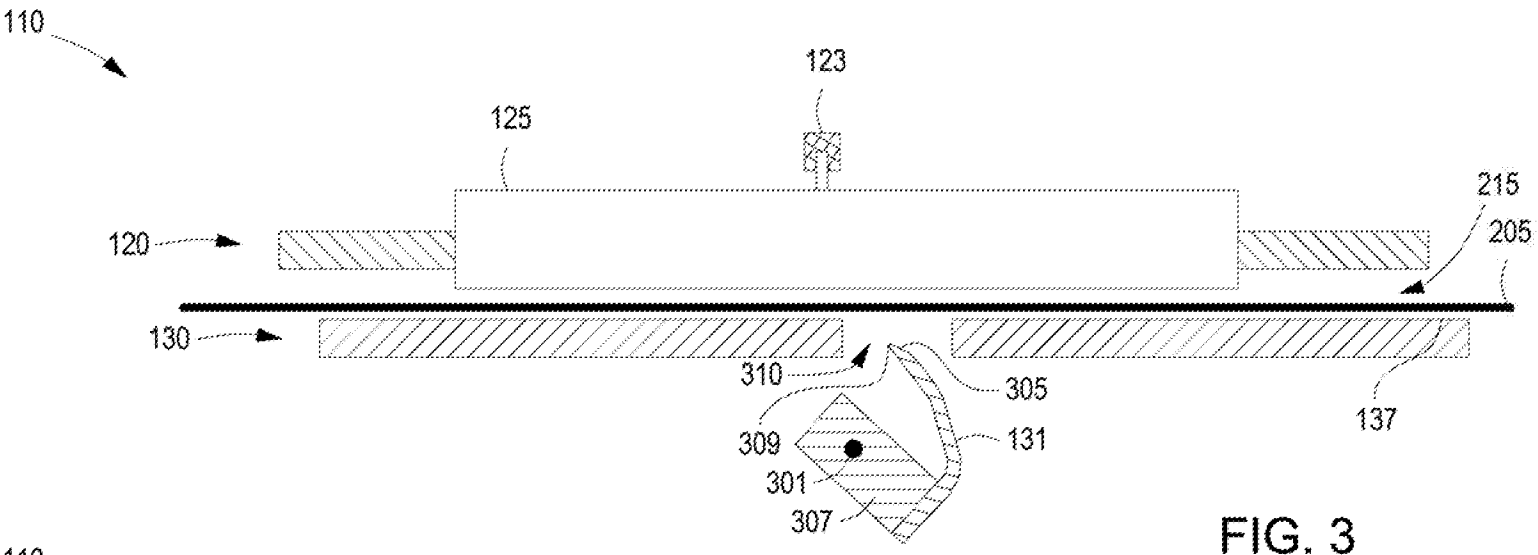
FIG. 3 depicts a cross-sectional view of an example print media handling system with a pressure plate in a retracted position.
Figure 4:
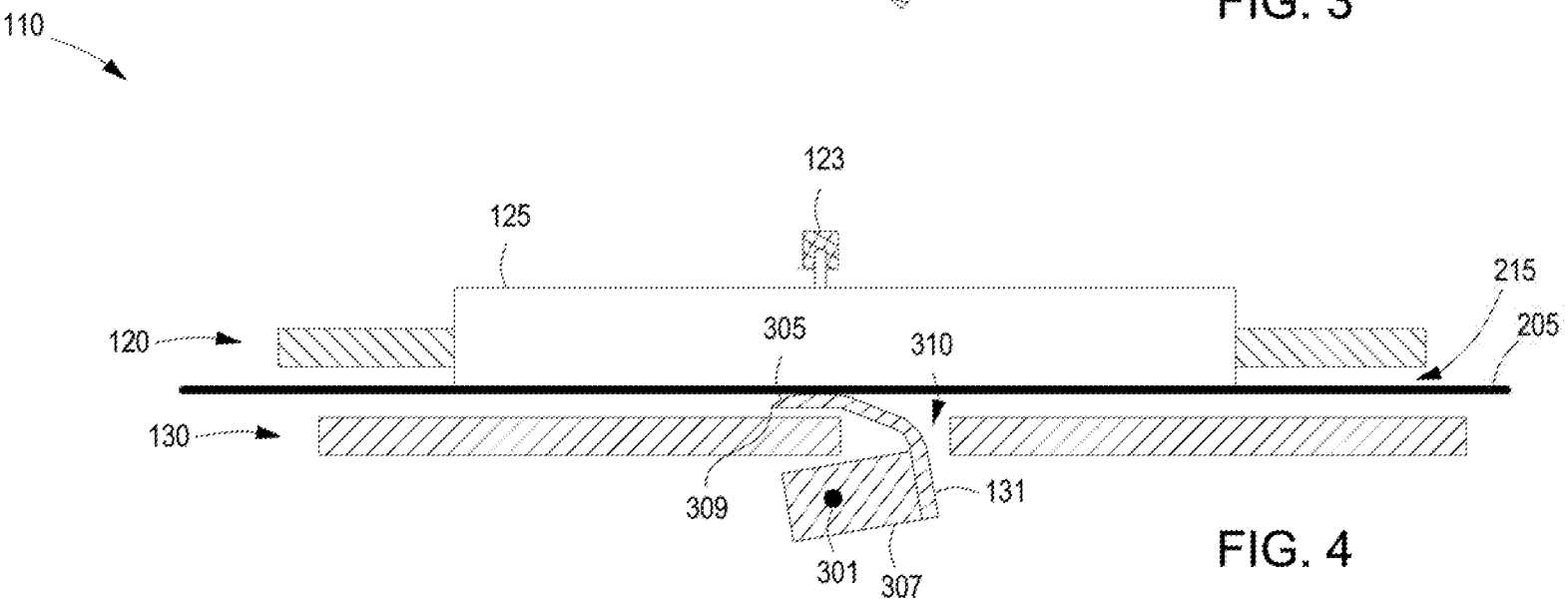
FIG. 4 depicts a cross-sectional view of an example print media handling system with a pressure plate in an actuated position.

FIG. 3 depicts a cross-sectional side view of the media handler assembly 110 with the pressure plate 131 in the retracted position, according to various examples of the present disclosure. While in the retracted position, the pressure plate 131 can be disposed below the lower media guide element 137. For example, as shown, the protruding end 309 of the pressure plate 131 can be disposed below the top surface of the lower media guide element 137 of the lower media guide 130. In the particular example shown, the protruding end 309 can be disposed in or below the gap 310 located in the lower media guide 130. As such, in the retracted position, none of the components of the pressure plate 131 interfere with the travel of print media 205 along the print media path 215.

In one particular example, the protruding end 309, which can include a curved region 305, of the pressure plate 131 can be arranged in the retracted position by rotating the actuator element 307 about pivot point 301. The curved region 305 can include a standoff elements 133 and gap region surface 135. In one example implementation, both the standoff elements 133 and the gap region surface 135 can include corresponding curved profiles. The curved profiles can have corresponding radii originating from a common center. As such, when the curved region 305 of the pressure plate 131 is disposed against the surface of the platen 125, the standoff elements 133 will ensure that the curved gap region surface 135 is at the same distance from the platen 125 when the pressure plate 131 is rotated into the actuated position shown in FIG. 4.

In various implementations, the pressure plate 131 can be rotated into the actuated position by rotating the actuator element 307 about the pivot point 301. Rotating the pressure plate 131 into the actuated position causes the protruding end 309 to passes through the opening 310 and into the print media path 215. In the actuated position, the curved region 305 makes contact with the surface of the platen 125 at the distal surface of the standoff elements 133 to dispose of the gap region surface 135 at a distance 235 from the surface of the platen. While in the actuated position, the pressure plate 131 causes the print media 205 to pass through the augmented print media path between the gap region surface 135 and the platen 125. As described herein, when the print media 205 is pressed toward the platen 125 by the gap region surface 135, the print media 205 is positioned within the depth of field or working distance of the sensor 123.

Figure 5:
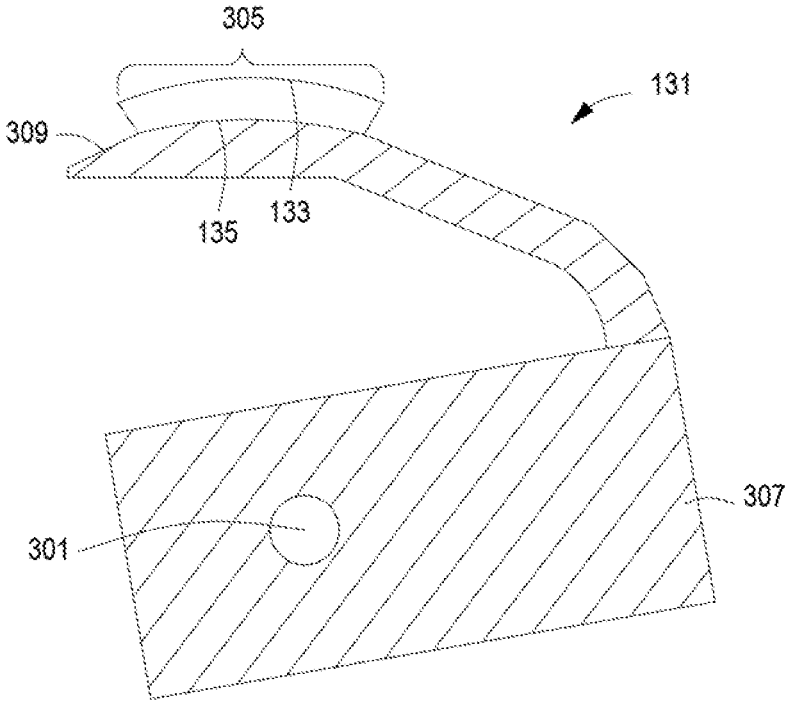
FIG. 5 depicts a detailed cross-sectional view of an example pressure plate.

FIG. 5 depicts a detailed cross-sectional view of the pressure plate 131. As depicted, the protruding end 309 can be coupled to the actuator element 307. Accordingly when the actuator element 307 rotates about the pivot point 301, the protruding end 309 and curved region 305 can move relative to the other elements in the media handler assembly 110 and/or printing device 100. As described herein, the protruding end 309 and the curved region 305 can be moved through an opening 310 in a lower media guide 130. While not shown in the accompanying figures, the opening 310 can include a protection element, such as a door or hatch, to block the opening 310 so as to protect the gap region surface 135 when the pressure plate 131 is disposed in the retracted position. Protecting the gap region surface 135 can help ensure that the surface remains free from contamination and damage (e.g., ink overspray, dust, scratch marks, smudges, and the like) when other elements of the printing device 110 and/or the media handler assembly 110 are operating.

In some implementations, the pressure plate 131 can be formed of a single material. In such implementations, the pressure plate 131 can include an injection moldable material such as plastic, vinyl, polycarbonate, and the like. In other example implementations, the actuator element 307 and portions of the protruding end 309 can include a composite of different materials and structures to provide rigidity, strength, and particular optical characteristics for the pressure plate 131. For example, the actuator element 307 and the protruding end 309 can be made of a machined piece of metal that include various structural features to provide flatness and rigidity to a piece of white or gray material used to build up the curved region 305. For example, the gap region surface 135 and the standoff elements 133 in the curved region 305 can include a white or otherwise opaque or reflective plastic material with which to back a print media 205 while it is being detected, scanned, or imaged by the sensor 123.

Figure 6:
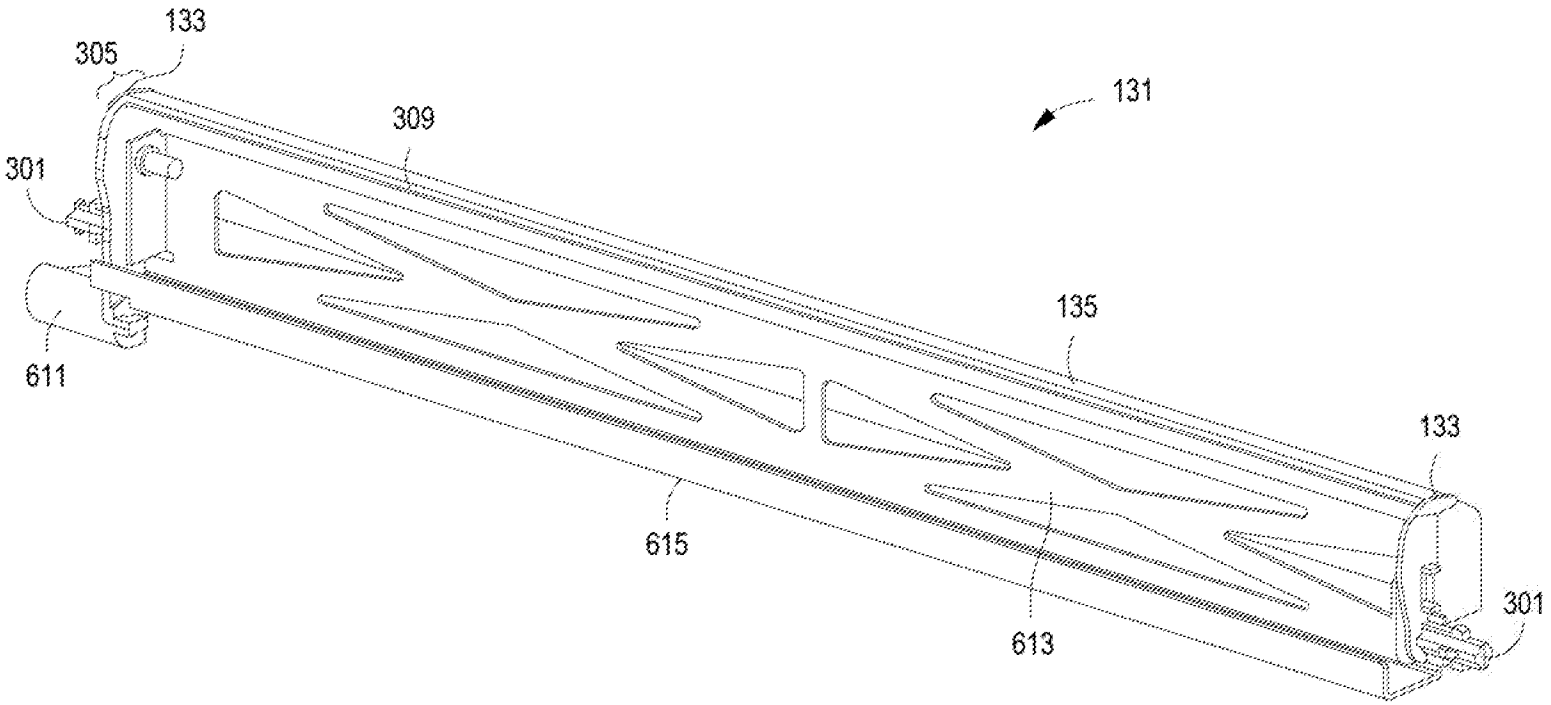
FIG. 6 illustrates a perspective view of an example pressure plate.

FIG. 6 depicts a perspective view of an example implementation of the pressure plate 131. The view depicted in FIG. 6 illustrates various structural elements that can be used to support and move the curved region 305 and its component gap region surface 135 and standoff elements 133. For example, the example pressure plate 131 depicts the curved region 305 as extending from one end to another end of a beam 615. In some implementations, the length of the curved region 305 from one end of the beam 615 to the other can correspond to the width of a page wide array print engine and/or sensor 123. As such, the standoff elements 133 may only make contact with a corresponding platen 125 at the ends of the gap region surface 135. To help ensure that the gap region surface 135 is flat and remains at a constant or relatively constant distance from the platen 125 or sensor 123, the pressure plate 131 can include cross member structural elements 613 to provide sufficient rigidity and support. Accordingly, when the example actuator element 611 is moved or pivoted about the pivot point 301, the curved region 305, including the standoff elements 133 and the gap region surface 135, also moved or pivot about the pivot point 301. In this manner, the curved region 305 of the pressure plate 131 can be moved between the retracted position and the actuated position depending on the needs of the printing device 100 and/or the media handler assembly 110 to scan, calibrate, or adjust the operations of other elements of the printing device 100.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A print media handling system comprising:

a first media guide assembly supporting a platen and comprising a sensor assembly; and a second media guide assembly comprising a retractable pressure plate and a media guide element and disposed opposite the first media guide assembly to guide a print media along a print media path between the first media guide assembly and second media guide assembly, the pressure plate actuatable about an axis perpendicular to the print media path between an extended position and a retracted positioned, wherein in the retracted position media advances along the print media path and past the pressure plate during printing on the media and the media is a first distance away from the platen corresponding to a distance from a print engine at which the print engine generates a printed image on the media at a specified print quality, wherein in the extended position the media advances along the print media path and past the pressure plate during optical scanning of the media and the media is a second distance away from the platen that is less than the first distance, wherein the pressure plate comprises a standoff that contacts the platen in the extended position while media advances past the standoff, and wherein the media guide element of the second media guide assembly remains stationary relative to the platen of the first media guide assembly during movement of the pressure plate between the extended and retracted positions.

2. The system of claim 1 wherein the sensor comprises an optical sensor, and the pressure plate when in the extended position, is disposed transverse to the print media path to press the print media toward the optical sensor.

3. The system of claim 2 wherein the pressure plate further comprises a gap region surface, the standoff to physically register against the platen to position the gap region surface within a depth of field of the optical sensor.

4. The system of claim 1 wherein the standoff element comprises a first semicircular profile and the gap region surface comprises a second semicircular profile concentric with the first semicircular profile.

5. The system of claim 1 wherein the pressure plate when in the retracted position is out of the print media path.

6. The system of claim 5 further comprising a protection element to shield the pressure plate while in the retracted position.

7. The system of claim 1 wherein the pressure plate comprises an opaque or reflective material.

8. A printer comprising:

a first media guide assembly supporting a platen;

a second media guide assembly comprising a retractable pressure plate and a media guide element and disposed opposite the first media guide assembly to define a print media path in a first gap between the first media guide assembly and second media guide assembly, the pressure plate actuatable about an axis perpendicular to the path between an extended position and a retracted position;

a print engine disposed along the print media path to print on media while the media advances along the print media path and past the pressure plate in the retracted position of the pressure plate in which the media is a first distance away from the platen corresponding to a distance from the print engine at which the print engine generates a printed image on the media at a specified print quality; and a sensor assembly disposed downstream the print media path relative to the print engine to scan the media while the media advances along the print media path and past the pressure plate in the extended position of the pressure plate in which the media is a second distance away from the platen that is less than the first distance, wherein the pressure plate comprises a standoff that contacts the platen in the extended position while media advances past the standoff, and wherein the media guide element of the second media guide assembly remains stationary relative to the platen of the first media guide assembly during movement of the pressure plate between the extended and retracted positions.

9. The printer of claim 8, wherein, in the extended position, the pressure plate defines a second gap between the pressure plate and the sensor assembly having, wherein the second gap is narrower than the first gap.

10. The printer of claim 8, wherein the second media guide assembly further comprises a protection element, and, when in the retracted position, the pressure plate is protected from the print engine by the protection element.

11. The printer of claim 8, wherein the pressure plate comprises a curved surface to press a print medium against the sensor assembly, the curved surface comprising a radius centered on an axis transverse to the print media path.

12. The printer of claim 11, wherein the standoff is disposed at an end of the curved surface to maintain a uniform gap between the curved surface and the sensor assembly when the pressure plate is in the extended position.

13. The printer of claim 12, wherein a dimension of the uniform gap corresponds to a working distance of the sensor assembly.

14. The printer of claim 8, wherein the sensor assembly comprises an optical sensor and the standoff has a height corresponding to a depth of field of the optical sensor.

15. The printer of claim 8, wherein the pressure plate comprises a white or gray tone plastic material.

16. The printer of claim 8, wherein the standoff is a first standoff, the pressure plate further comprises a second standoff and a cavity between the first and second standoffs, and the media advances within the cavity in the extended position of the pressure plate.

* * * * *